US006789883B2

(12) United States Patent
Heim et al.

(10) Patent No.: US 6,789,883 B2
(45) **Date of Patent: *Sep. 14, 2004**

(54) METHOD AND APPARATUS FOR COMPENSATING FOR INK CONTAINER EXTRACTION CHARACTERISTICS

(75) Inventors: Rory A. Heim, Corvallis, OR (US); David R. Otis, Jr., C rvallis, OR (US); David Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/851,765

(22) Filed: May 9, 2001

(65) Prior Publication Data

US 2002/0167572 A1 Nov. 14, 2002

(51) Int. Cl.[7] ..... B41J 2/175
(52) U.S. Cl. ..... 347/85
(58) Field of Search ..... 347/7, 14, 19, 347/85–87

(56) References Cited

U.S. PATENT DOCUMENTS

| | | | | |
|---|---|---|---|---|
| 4,771,295 A | | 9/1988 | Baker et al. | 347/87 |
| 4,961,088 A | | 10/1990 | Gilliland et al. | 399/25 |
| 5,610,635 A | | 3/1997 | Murray et al. | 347/7 |
| 5,620,641 A | | 4/1997 | Berger | 264/103 |
| 6,155,664 A | * | 12/2000 | Cook | 347/7 |
| 6,305,795 B2 | * | 10/2001 | Childers et al. | 347/86 |
| 6,454,381 B1 | * | 9/2002 | Olsen et al. | 347/19 |

FOREIGN PATENT DOCUMENTS

| | | | |
|---|---|---|---|
| EP | 0691207 A2 | 1/1996 | B41J/2/175 |
| EP | 0720916 A2 | 7/1996 | B41J/2/175 |
| EP | 0789322 A2 | 1/1997 | G06K/15/00 |
| EP | 0 925 920 | 6/1999 | |
| EP | 0 925 938 | 6/1999 | |
| EP | 0721171 B1 | 6/2000 | G06K/15/00 |
| EP | 1 059 169 | 12/2000 | |
| FR | 2 744 061 | 8/1997 | |
| WO | WO01/32431 A1 | 5/2001 | B41J/2/175 |

OTHER PUBLICATIONS

A copy of PCT International Search Report for International Application No. PCT/US02/12402 mailed Aug. 9, 2002 (7 pages).

* cited by examiner

*Primary Examiner*—Michael Nghiem

(57) ABSTRACT

The present disclosure relates to an inkjet printing system configured for receiving a replaceable ink container. The replaceable ink container has an ink extraction characteristic that varies with ink level in the replaceable ink container. The inkjet printing system includes an ink level determining device for determining ink level within the replaceable ink container. Also included is a control device for selecting a print mode based on ink extraction characteristics of the replaceable ink container.

33 Claims, 13 Drawing Sheets

METHOD AND APPARATUS FOR COMPENSATING FOR INK CONTAINER EXTRACTION CHARACTERISTICS

BACKGROUND OF THE INVENTION

The present invention relates to ink-jet printing systems that make use of a replaceable printing component. More particularly, the present invention relates to replaceable printing components that include an electrical storage device for providing information to the printing system.

Ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. patent application Ser. No. 08/584,499 entitled "Replaceable Part With Integral Memory For Usage, Calibration And Other Data" assigned to the assignee of the present invention. patent application Ser. No. 08/584,499 discloses the use of a memory device, which contains parameters relating to the replaceable part. The installation of the replaceable part allows the printer to access the replaceable part parameters to insure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable component parameters insures high print quality. In addition, this automatic parameter updating tends to ensure the printer is not inadvertently damaged due to improper operation, such as, operating after the supply of ink is exhausted or operation with the wrong or non-compatible printer components.

SUMMARY OF THE INVENTION

One aspect of the present invention is an inkjet printing system configured for receiving a replaceable ink container. The replaceable ink container has an ink extraction characteristic that varies with ink level in the replaceable ink container. The inkjet printing system includes an ink level determining device for determining ink level within the replaceable ink container. Also included is a control device for selecting a print mode based on ink extraction characteristics of the replaceable ink container.

Another aspect of the present invention is that the print mode is selected from a plurality of print modes. The plurality of print modes includes a first printing mode with a first ink usage rate and a second printing mode with a second ink usage rate different from the first usage rate.

Yet another aspect of the present invention is an inkjet printing system having a printhead responsive to control signals for depositing ink on media and an ink delivery system for delivering ink to the printhead. The inkjet printing system includes a monitoring device for monitoring ink delivered to the printhead by the ink delivery system. Also included is a control device for adjusting print rate based on an ink deposited on media and ink delivered to the printhead.

DETAILED DESCRIPTION OF THE PREFERRED EMBODIMENT

Figure 1:
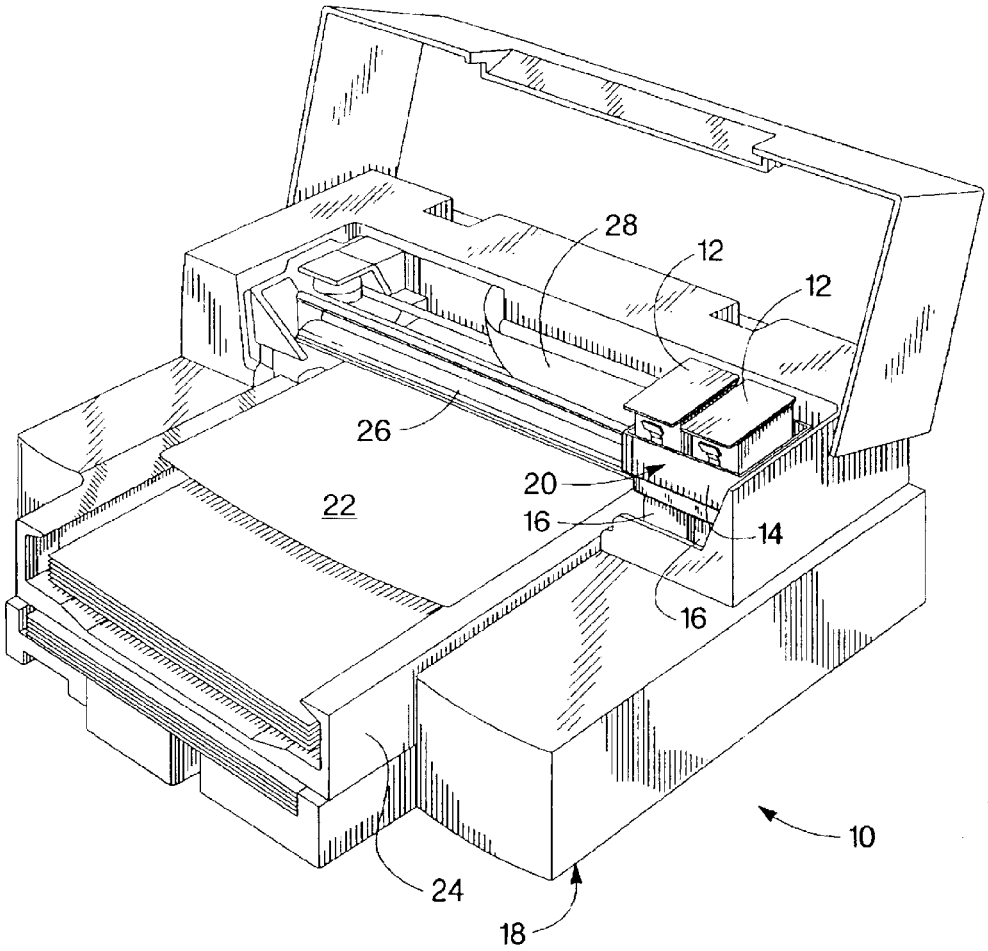
FIG. 1 is one exemplary embodiment of an inkjet printing system of the present invention shown with a cover opened to show a plurality of replaceable ink containers of the present invention.

FIG. 1 is a perspective view of one exemplary embodiment of a printing system 10 shown with its cover open, which includes at least one replaceable ink container 12 that is installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12.

In one exemplary embodiment the replaceable ink container 12, receiving station 14, and inkjet printhead 16 are each part of a scanning carriage 20 that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism that includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

The ink-jet printing system 10 shown in FIG. 1 is configured to receive ink containers 12 having ink extraction characteristics that vary with ink level in the ink container. These ink extraction characteristics in general vary with the size of the ink container 12. One exemplary ink extraction characteristic is a backpressure characteristic within the ink container 12. As ink is extracted from the ink container 12 the backpressure within the ink container 12 varies. This back pressure variation, if not properly compensated for in the printing system 10, can lead to a variety of problems for the printing system 10. These problems include reduction of print quality due to excessive backpressure, reduction of printhead reliability due to air ingestion and increased stranding of ink in the ink container 12, to name a few problems.

One aspect of the present invention is a method and apparatus for storing ink extraction characteristics on the replaceable ink containers 12. The extraction characteristics are used for updating operation parameters of the printer portion 10. The printing system 10 makes use of these extraction characteristics to compensate for these characteristics to achieve high print quality while more fully extracting ink from the ink container 12.

For example, in the case where the ink extraction characteristic varies with ink level within the ink container 12 for a given extraction rate the backpressure will increase as ink is extracted from the ink container 12. Therefore, without properly compensating for this extraction characteristic the printing system 10 is not able to extract ink at low ink levels where backpressures are highest resulting in the stranding of ink within the ink container 12. Stranding of ink within the ink container 12 results in ink waste, higher printing costs per page and stranded ink entering the waste stream.

An electrical storage device is associated with each of the replaceable ink containers 12. The electrical storage device contains ink extraction information related to the particular replaceable ink container 12. Installation of the replaceable ink container 12 into the printer portion 10 allows ink extraction information to be transferred between the electrical storage device and the printer portion 18 to insure high print quality as well as to achieve improved ink extraction from the replaceable ink container 12. The information provided to the printing system 10 includes, among other information, information specifying ink extraction rate for different amounts of ink in the ink container 12. The printing system 10 uses these extraction characteristics to select a proper extraction rate based on ink remaining in the ink container 12. By adjusting the ink extraction rate as ink from the ink container 12 is used the printing system 10 can more fully extract ink from the ink container 12 without incurring problems with the printing system 10. The technique of the present invention will be discussed in more detail with respect to FIGS. 10–12. Before discussing this technique it will be helpful to first discuss the printing system 10 in more detail.

Although the printing system 10 shown in FIG. 1 makes use of ink containers 12 which are mounted on the scanning carriage 20, the present invention is equally well suited for other types of printing system configurations. One such configuration is one where the replaceable ink containers 12 are mounted off the scanning carriage 20. Alternatively, the printhead 16 and the ink container 12 may be incorporated into an integrated printing cartridge that is mounted to the scanning carriage 20. Finally, the printing system 10 may be used in a wide variety of applications such as facsimile machines, postal franking machines, textile printing devices and large format type printing systems suitable for use in displays and outdoor signage.

Figure 2:
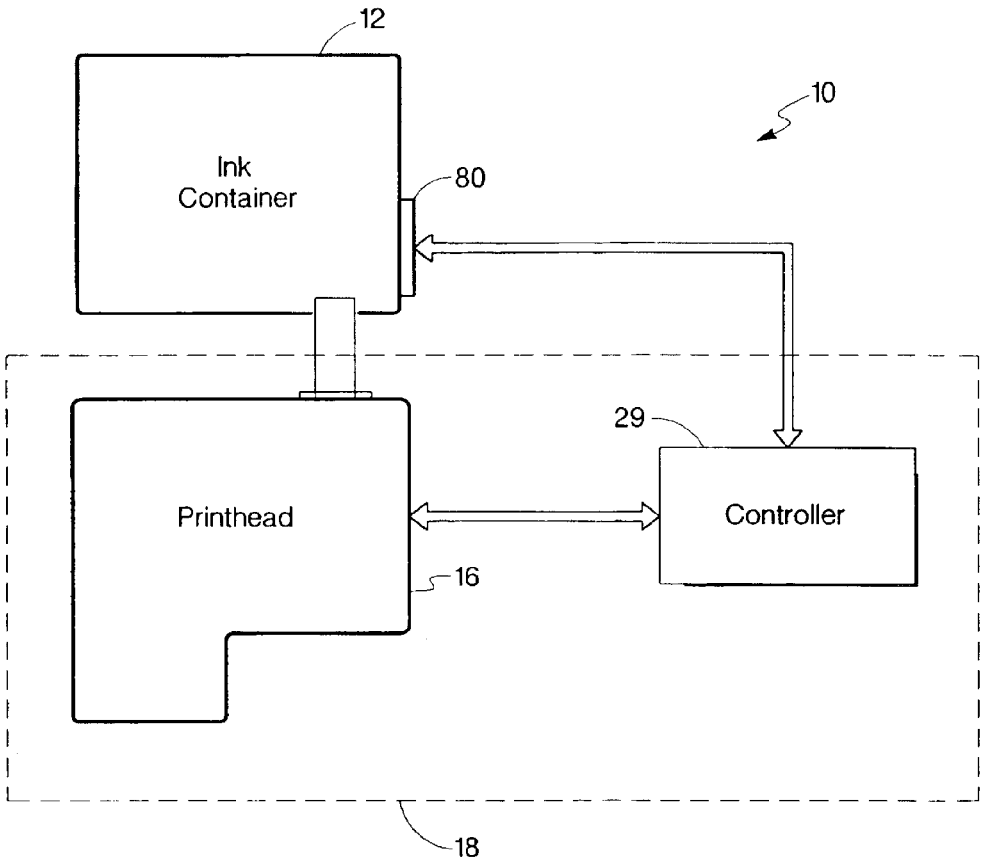
FIG. 2 is a schematic representation of the inkjet printing system shown in FIG. 1.

FIG. 2 is a simplified schematic representation of the inkjet printing system 10 of the present invention shown in FIG. 1. FIG. 2 is simplified to illustrate a single printhead 16 connected to a single ink container 12.

The inkjet printing system 10 of the present invention includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the printhead 16 and the controller 29 for activating the printhead to selectively deposit ink on print media. In addition, the controller 29 controls the relative movement of the printhead 16 and print media. The controller 29 performs additional functions such as controlling the transfer of information between the printing system 10 and a host device such as a host computer (not shown).

In order to ensure the printing system 10 provides high quality images on print media, it is necessary that the operation of the controller 29 accounts for the particular replaceable ink container 12 installed within the printer portion 18. The controller 29 utilizes the parameters that are provided by the electrical storage device 80 to account for the particular replaceable ink container 12 installed in the printer portion 18 to ensure reliable operation and ensure high quality print images.

Additional information, for example, that can be stored in the electrical storage device 80 associated with the replaceable ink container 12 can include information specifying an initial ink volume, a current ink volume and ink container 12 configuration information, just to name a few. The particular information stored on the electrical storage device 80 that relates to extraction characteristics will be discussed in more detail later.

Figure 3:
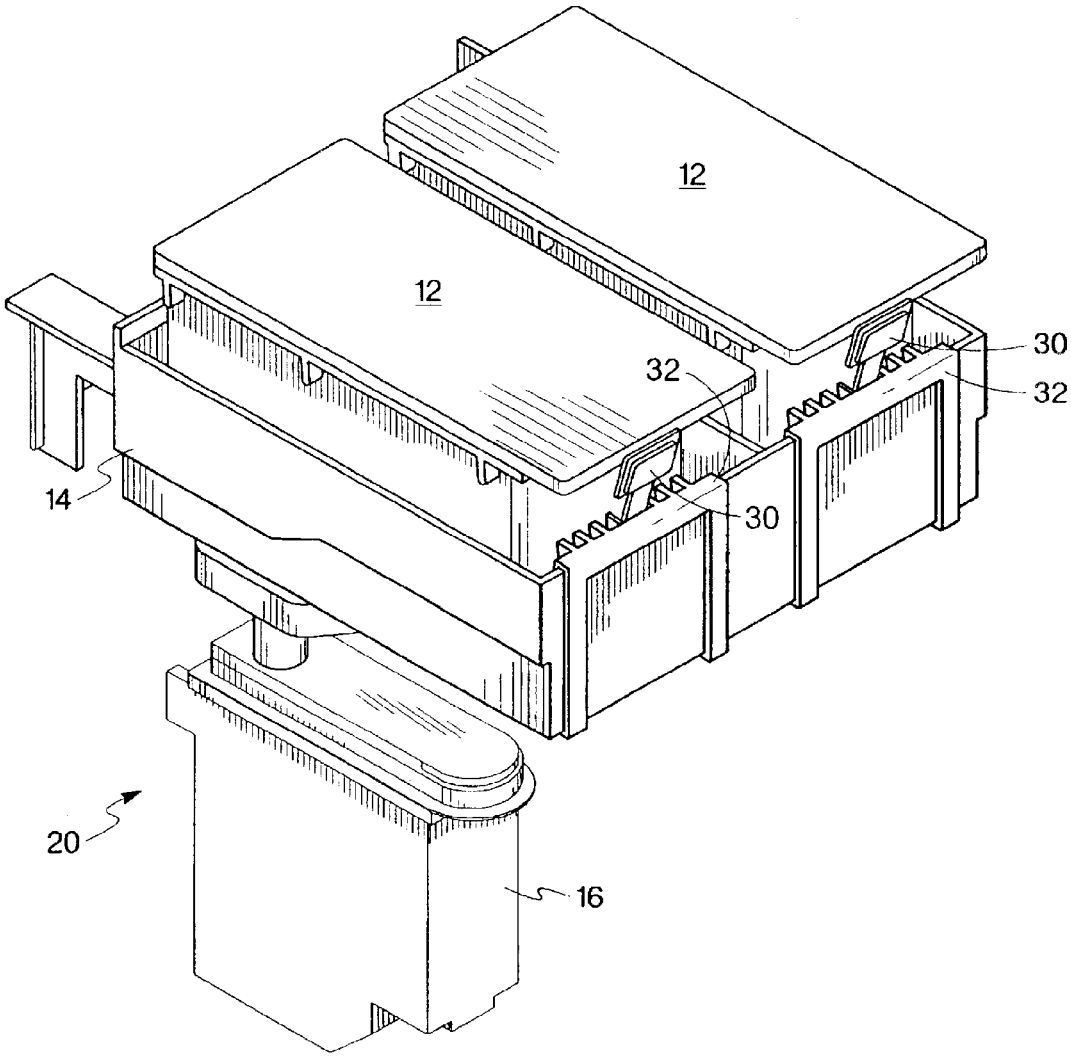
FIG. 3 is a greatly enlarged perspective view of a portion of a scanning carriage showing the replaceable ink containers of the present invention positioned in a receiving station that provides fluid communication between the replaceable ink containers and one or more printhead.

FIG. 3 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tri-color ink container containing three separate ink colors and a second ink container containing a single ink color. In this preferred embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The scanning carriage portion 20 shown in FIG. 3 is shown fluidically coupled to a single printhead 16 for simplicity. In the preferred embodiment, four inkjet printheads 16 are each fluidically coupled to the receiving station 14. In this preferred embodiment, each of the four printheads is fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations, which make use of fewer printheads than four, are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 4.

Each of the replaceable ink containers 12 includes a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 4:
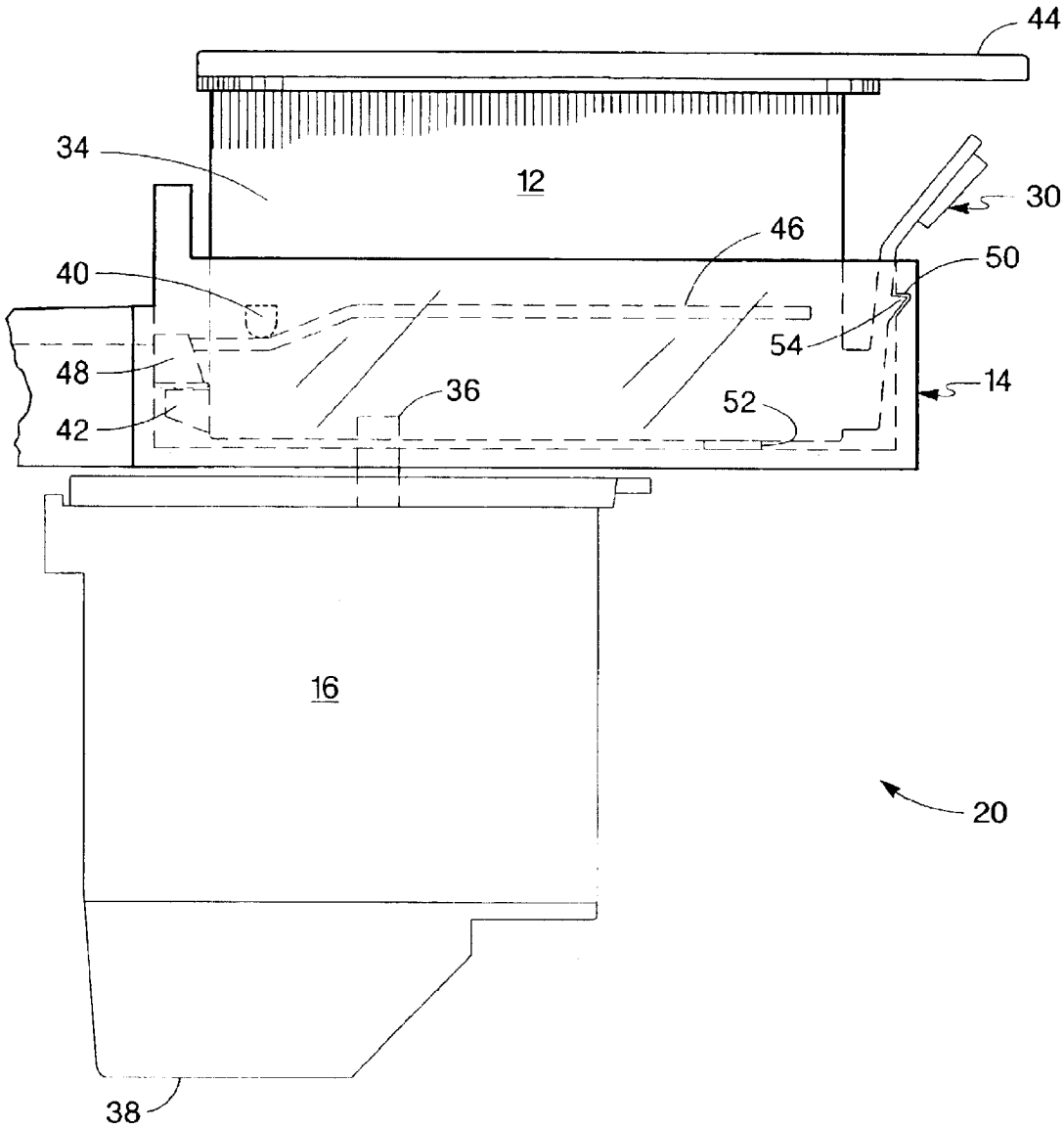
FIG. 4 is a side plan view of a portion of the scanning carriage showing guiding and latching features associated with each of the replaceable ink container and the receiving station for securing the replaceable ink container, thereby allowing fluid communication with the printhead.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in US Patent Application entitled "Ink Reservoir for an Inkjet Printer" filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. Gauge pressure is the pressure measured within the ink container relative to atmospheric pressure. This negative gauge pressure within the printhead 16 is sufficient to overcome the capillary force resulting from the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 4. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 5.

Figure 5:
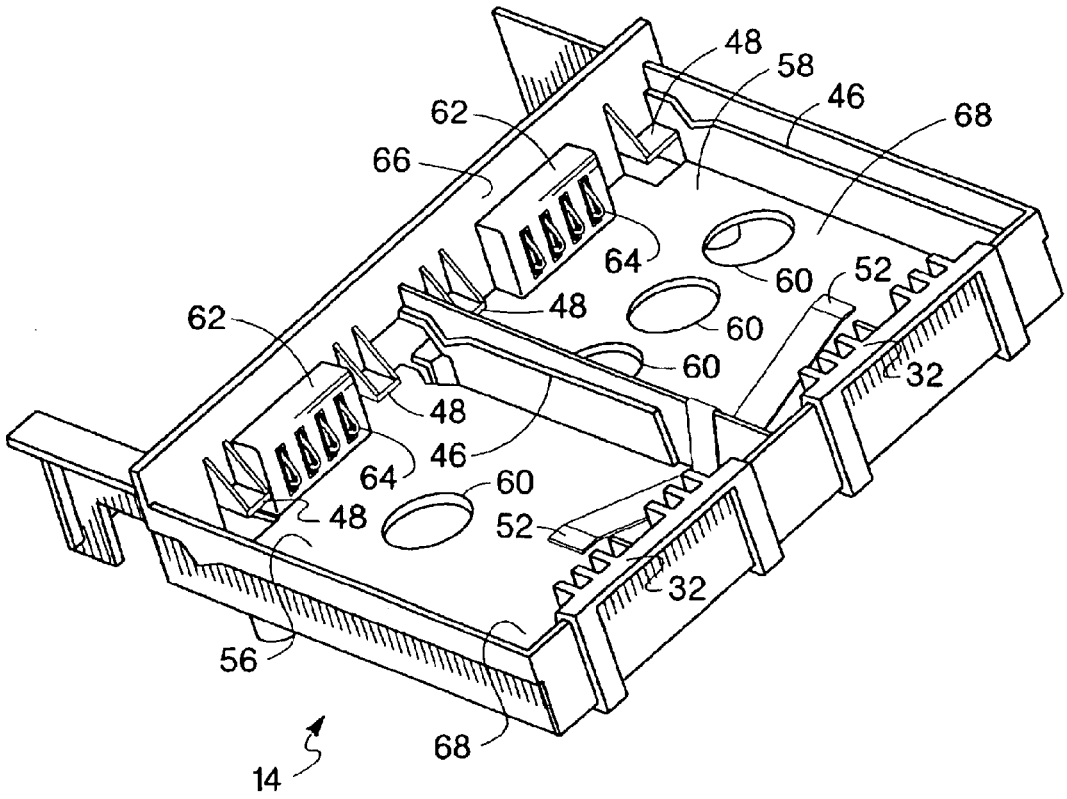
FIG. 5 is a receiving station shown in isolation for receiving one or more replaceable ink containers of the present invention.

FIG. 5 is a front perspective view of the ink container receiving station 14 shown in isolation. The receiving station 14 shown in FIG. 5 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be other than two. For example, a receiving station 14 can have four separate bays for receiving four separate monochrome ink containers 12 with each ink container containing a separate ink color to accomplish four-color printing.

Each bay 56 and 58 of the receiving station 14 include an aperture 60 for receiving each of the upright fluid interconnects 36 that extend there through. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts 64 are an arrangement of four spring-loaded electrical contacts with proper installation of the replaceable ink container 12 into the corresponding bay of the receiving station 14. Proper engagement with each of the electrical connectors 62 and fluid interconnects 36 must be established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14.

Figure 6:
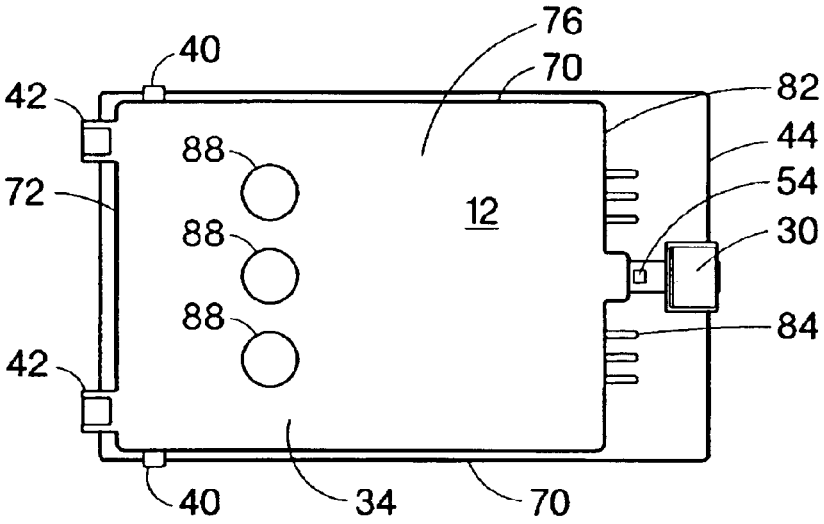
FIG. 6 is a bottom plan view of a three-color replaceable ink container of the present invention shown in isolation.

FIG. 6 is a bottom plan view of the replaceable ink container 12 of the present invention. The replaceable ink container 12 includes a pair of outwardly projecting guide rail engagement features 40. In the preferred embodiment, each of these guide rail engagement features 40 extend outwardly in a direction orthogonal to upright side 70 of the replaceable ink container 12. The engagement features 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78 electrically connected to an electrical storage device 80.

Opposite the leading end 72 is a trailing end 82. The trailing end 82 of the replaceable ink container 12 includes the latch feature 30 having an engagement hook 54. The latch feature 30 is formed of a resilient material, which allows the latch feature to extend outwardly from the trailing end thereby extending the engagement feature outwardly toward the corresponding engagement feature associated with the receiving station 14. As the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or compatibility with the corresponding receiving bay 56 and 58 within the receiving station 14.

The handle portion 44 disposed on a top surface at the trailing edge 82 of the replaceable ink container 12. The handle portion 44 allows the ink container 12 to be grasped at the trailing edge 82 while inserted into the appropriate bay of the receiving station 14.

The ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding printhead for that ink color.

Figure 7:
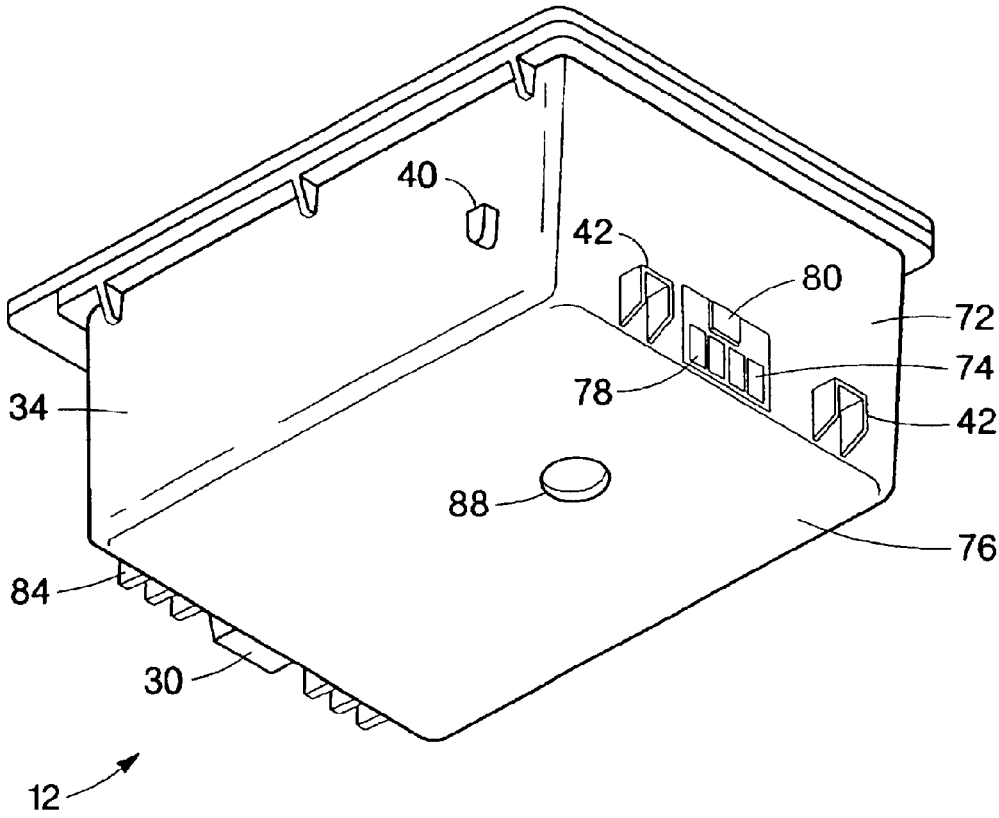
FIG. 7 is a perspective view of a single color replaceable ink container of the present invention.

FIG. 7 is a perspective view of a monochrome ink container positioned for insertion into the monochrome bay 56 in the receiving station 14 shown in FIG. 5. The monochrome ink container shown in FIG. 7 is similar to the tri-color ink container shown in FIG. 6 except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 8:
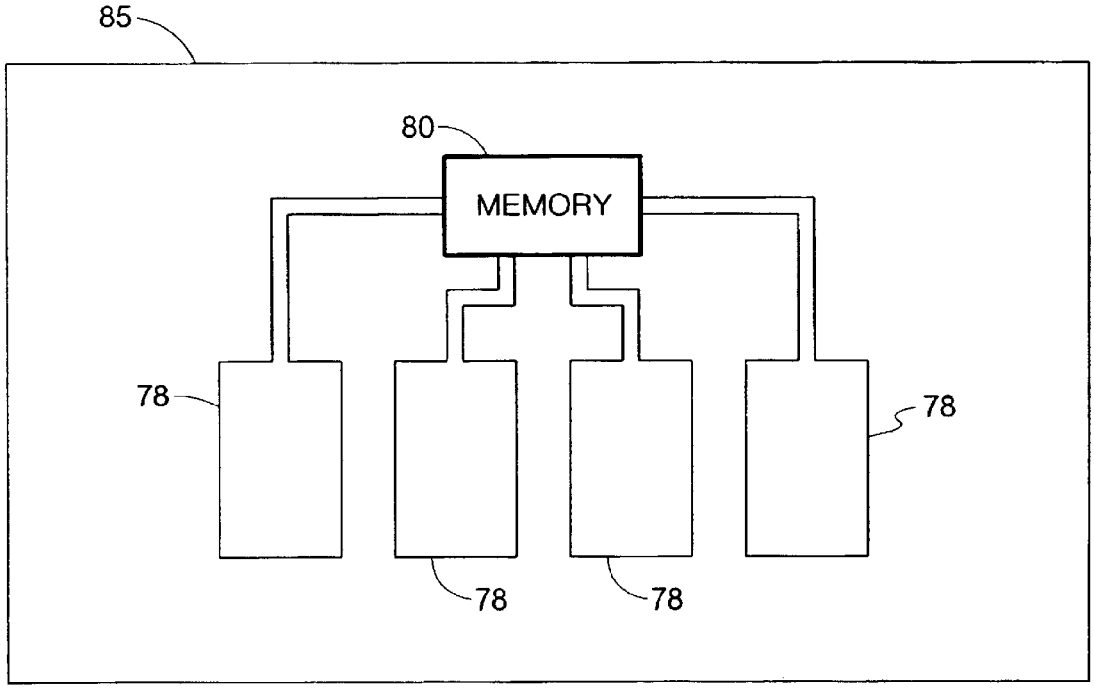
FIG. 8 is a top plan view of an electrical storage device that is electrically connected to a plurality of electrical contacts.

FIG. 8 is a greatly enlarged view of the electrical storage device 80 and electrical contact 78. In one preferred embodiment, the electrical storage device 80 and the electrical contacts are mounted on a substrate 85. Each of the electrical contacts 78 is electrically connected to the electrical storage device 80. Each of the electrical contacts 78 is electrically isolated from each other by the substrate 85. In one preferred embodiment, the electrical storage device 80 is a semiconductor memory that is mounted to the substrate 85. In the preferred embodiment, the substrate 85 is adhesively bonded to the ink container 12.

In one preferred embodiment, there are four electrical contacts 78 representing contacts for power and ground connections as well as clock and data connections. Insertion of the replaceable ink container 12 into the printing portion 18 establishes electrical connection between the electrical contact 64 on the receiving station 14 and the electrical contacts 78 on the replaceable ink container 12. With power and ground applied to the electrical storage device 80, data is transferred between the printing portion 18 and the replaceable ink container 12 at a rate established by the clock signal. It is critical that electrical connection between the printer portion 18 and the replaceable ink container 12 formed by electrical contacts 64 and 78, respectively, be low resistance connections to ensure reliable data transfer. If the electrical contacts 64 and 78 fail to provide a low resistance connection, then data may not be properly transferred, or the data may be corrupted or inaccurate. Therefore, it is critical that reliable, low resistance connection is made between the ink container 12 and the printing portion 18 to ensure proper operation of the printing system 10.

Figure 9:
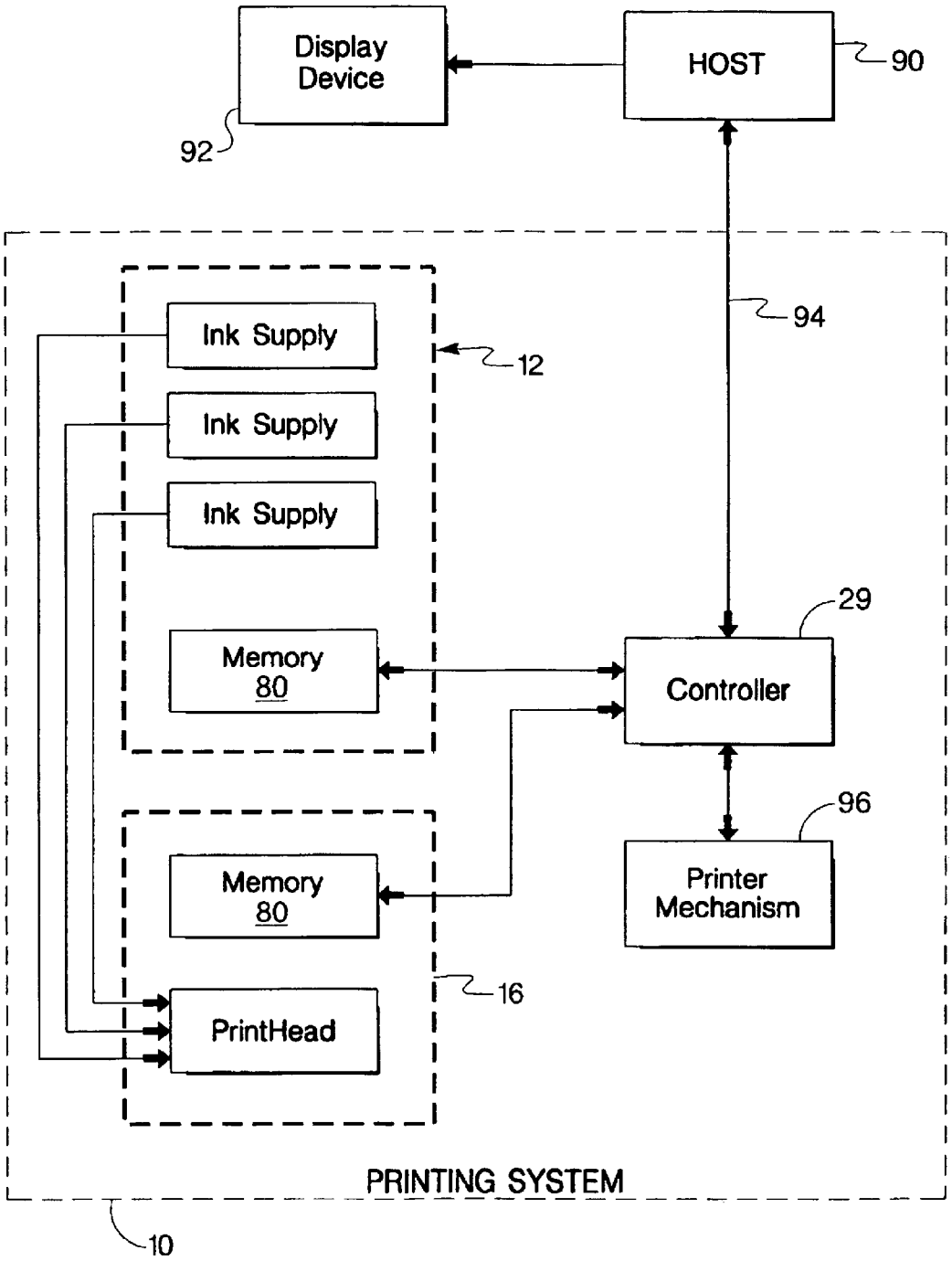
FIG. 9 depicts a schematic block diagram of the ink-jet printing system of FIG. 1 shown connected to a host and which includes the replaceable ink container and printhead each of which contain electrical storage devices.

FIG. 9 represents a block diagram of the printing system 10 of the present invention shown connected to an information source or host computer 90. The host computer 90 is shown connected to a display device 92. The host 90 can be a variety of information sources such as a personal computer, work station, or server to name a few, that provides image information to the controller 29 by way of a data link 94. The data link 94 may be any one of a variety of conventional data links such as an electrical link or an infrared link for transferring information between the host 90 and the printing system 10.

The ink container 12 shown in FIG. 9 includes the electrical storage device 80 and three separate ink supplies representing the tri-color ink container 12 shown in FIG. 6. When properly inserted into the tri-color receiving bay 58 fluid communication is established between each of the separate ink supplies or chambers and one or more inkjet printheads 16.

The controller 29 is electrically connected to the electrical storage devices 80 associated with each of the printhead 16 and the ink container 12. In addition, the controller 29 is electrically connected to a printer mechanism 96 for controlling media transport and movement of the carriage 20. The controller 29 makes use of parameters and information provided by the host 90, the memory 80 associated with the ink container 12 and memory 80 associated with the printhead 16 to accomplish printing.

The host computer 90 provides image description information or image data to the printing system 10 for forming images on print media. In addition, the host computer 90 provides various parameters for controlling operation of the printing system 10, which is typically resident in printer control software typically referred to as the "print driver". In order to ensure the printing system 10 provides the highest quality images it is necessary that the operation of the controller 29 compensate for the particular replaceable ink container 12 installed within the printing system 10. It is the electric storage device 80 that is associated with each replaceable ink container 12 that provides parameters particular to the replaceable ink container 12 that allows the controller 29 to utilize these parameters to ensure the reliable operation of the printing system 10 and insure high quality print images.

Figure 10:
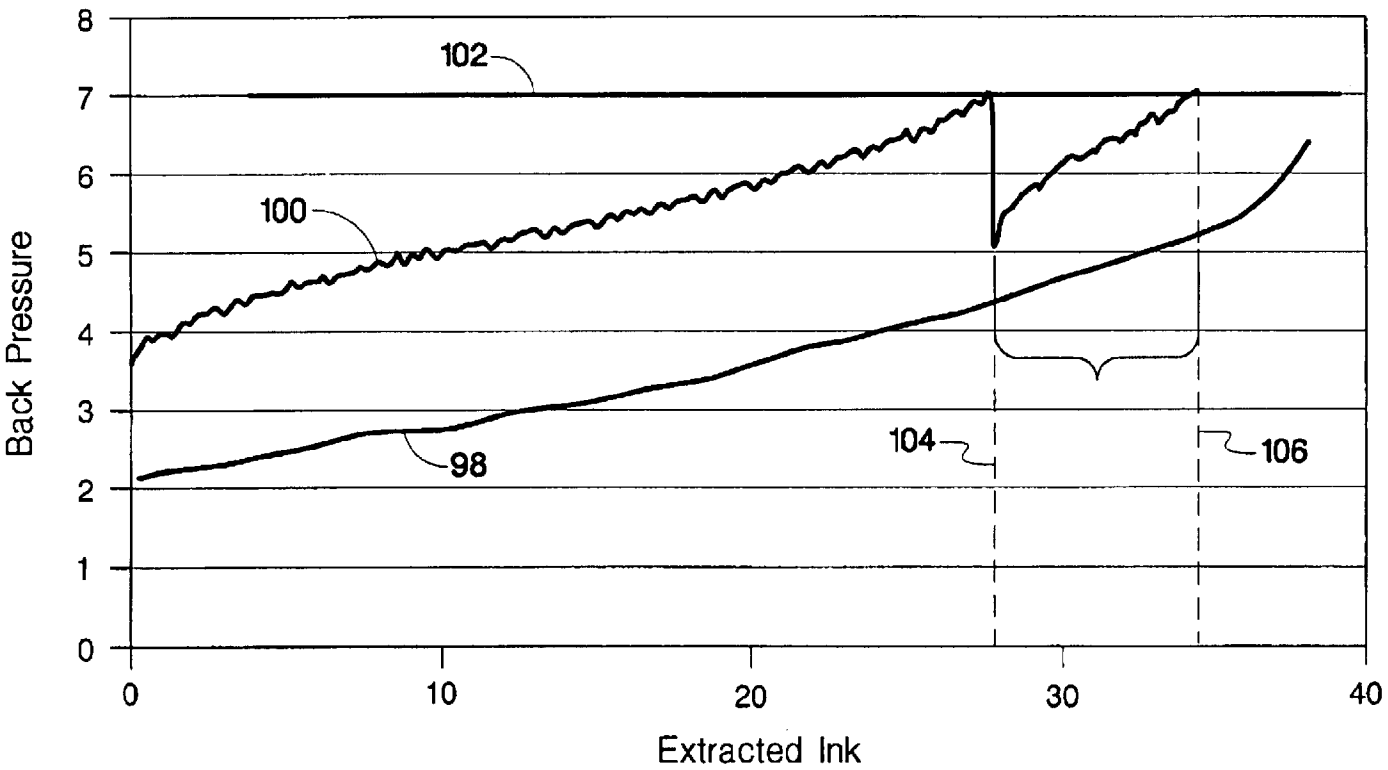
FIG. 10 is a representation of both static and dynamic backpressure in the ink container of the present invention for varying amounts of ink extracted.

FIG. 10 is a representation of backpressure magnitude within the ink container 12 versus extracted ink from the ink container 12. Backpressure or gauge pressure that is shown in FIG. 10 is a negative pressure because this pressure is below atmospheric pressure. For simplicity, the backpressure within the ink container is represented as a magnitude or as the negative of the gauge pressure. In FIG. 10 the backpressure is specified in inches of water and the extracted ink is specified in cubic centimeters of ink. In general, as ink is extracted from the ink container 12, the backpressure or gauge pressure within the ink container tends to increase or become more negative. There are two components of backpressure as shown in FIG. 10, static backpressure is represented by curve 98 and dynamic backpressure is represented by curve 100. As backpressure within the ink container 12 increases, the drop size ejected from the printhead 16 tends to decrease. Once the backpressure reaches a maximum operating backpressure as represented by curve 102 further increases in back pressure will reduce print quality. Print quality is reduced because of drop size variation which, if sufficient can degrade the output image or change color hue in the printed image. In addition to loss of print quality, damage to the printhead 16 can occur if the printhead 16 operated for too long under high backpressure conditions. This printhead 16 damage results from air ingestion or thermal damage due to reduced ink flow through the printhead 16.

The technique of the present invention, allows the backpressure within the ink container to be maintained below the maximum operational backpressure to prevent degradation in print quality, prevent damage to the printhead 16 and allow ink to be more fully extracted from the ink container 12. Before discussing details of the present invention, it will be helpful to first discuss the static and dynamic backpressure components, each of which contribute to a reduction of print quality.

Static backpressure is a backpressure or gauge pressure within the ink container 12 that exists when ink is not being extracted from the ink container 12. A static backpressure or steady state backpressure exists in the ink container 12 when the printing system 10 is not printing. This static backpressure component results from the capillarity of a capillary storage member within the ink container 12. The capillary storage member in a preferred embodiment is a network of fibers that forms a self-sustaining structure. These network of fibers define spacings or gaps between the fibers, which form a tortuous interstitial path. This interstitial path is formed to have excellent capillarity properties for retaining ink within the capillary storage member. In one exemplary embodiment, the static backpressure increases from two inches to approximately six inches of water as ink is extracted from the tortuous interstitial path within the capillary storage member.

In one exemplary embodiment, the capillary storage member is a bi-component fiber having a polypropylene core material and a polyethylene terephthalate sheath material. This bi-component fiber is described in more detail in U.S. patent application Ser. No. 09/430,400 entitled "Ink Reservoir For An Inkjet Printer", filed Oct. 29, 1999 to David Olsen, Jeffrey Pew, and David C. Johnson, and assigned to the assignee of the present invention.

The dynamic component of backpressure as represented by curve 100 is the backpressure within the ink container 12 that results from ink extraction from the ink container 12. It can be seen from curve 100 at a constant extraction rate of one cubic centimeter per minute of ink from the ink container 12, the back pressure increases with increasing amounts of ink extracted from the ink container 12. The dynamic backpressure component tends to be higher than the static backpressure component as represented by curve 98. The dynamic backpressure component is a function of a resistance to the extraction of ink from the tortuous capillary ink path within the capillary storage member. As more ink is extracted from the capillary storage member, the capillary path in which ink must flow to be extracted from the storage member tends to increase. This increase in the extraction path tends to increase the backpressure within the ink container 12.

At a constant extraction rate of 1 cubic centimeter per minute of ink from the ink container 12, the dynamic backpressure represented by curve 100 reaches the maximum operating backpressure 102 when approximately 27 cubic centimeters (see dashed line 104) is extracted from the ink container 12. Further extraction of ink from the ink container 12 beyond the maximum operational backpressure at the extraction rate of 1 cubic centimeter per minute will result in loss of print quality. The technique of the present invention allows the extraction characteristics to be used to adjust the ink extraction rate to prevent operation of the printing system 10 beyond the maximum operational backpressure. In the exemplary embodiment, the extraction rate is reduced from 1 cubic centimeter per minute to 0.25 cubic centimeters per minute to allow ink to be further extracted from the ink container 12. At the extraction rate of 0.25 cubic centimeters per minute, the maximum operational backpressure represented by curve 102 is not reached until approximately 35 cubic centimeters (see dashed line 106) are extracted from the ink container 12. By adjusting the extraction rate of ink from the ink container 12, eight additional cubic centimeters of ink can be extracted from the ink container 12 as represented by the difference between the ink extracted at 0.25 cubic centimeters per minute and the ink extracted at an ink extraction rate of 1 cubic centimeters per minute.

The extraction rate of ink from the ink container 12 is directly related to the print rate of the printhead 16. A variety of techniques can be used to reduce the print rate of the printhead 16 thereby reducing the extraction rate from the ink container 12. These techniques include selecting a print mode from a variety of different print modes. Each of the print modes is configured to have a different rate of ink extraction. In this manner, the print mode or extraction rate is selected based on the ink extraction characteristics of the ink container 12.

For example, one print mode is printing with a pause for a selected period of time during the printing of each print swath. This pause in printing tends to reduce the average rate of ink extraction from the ink container 12 during the print swath. Additional print modes can be added the each have a different selected period of time in which printing is paused.

Alternatively, the print mode can activate only a subset of the available nozzles on the printhead. One such print mode is a dual pass print mode wherein only half the nozzles on the printhead 16 are operated in two successive passes of the same print swath. A complete print swath is printed but at half the ink extraction rate at a single pass printing in which all the print nozzles are operated in a single pass.

The technique of the present invention, allows ink to be extracted from the ink container 12 at a given extraction rate. The extraction rate can be reduced upon the occurrence of an appropriate condition for reducing the ink extraction rate from the ink container 12 so that more ink can be extracted from the ink container 12. One such condition for adjusting the extraction rate is when the backpressure within the ink container reaches a threshold backpressure value such as maximum operational backpressure. Alternatively, the ink extraction rate from the ink container 12 can be reduced when a threshold amount of ink is extracted from the ink container 12. The ink extraction rate is then reduced so that a greater amount of ink can be extracted from the ink container 12.

The technique of the present invention can be used to select different extraction rates for print modes from a plurality of different print modes based on ink extracted from the ink container or backpressure within the ink container. Moreover, the extraction rate can be continually varied during operation of the printing system 10 based on ink extraction or dynamic backpressure to optimize ink extraction from the ink container 12.

Figure 11:
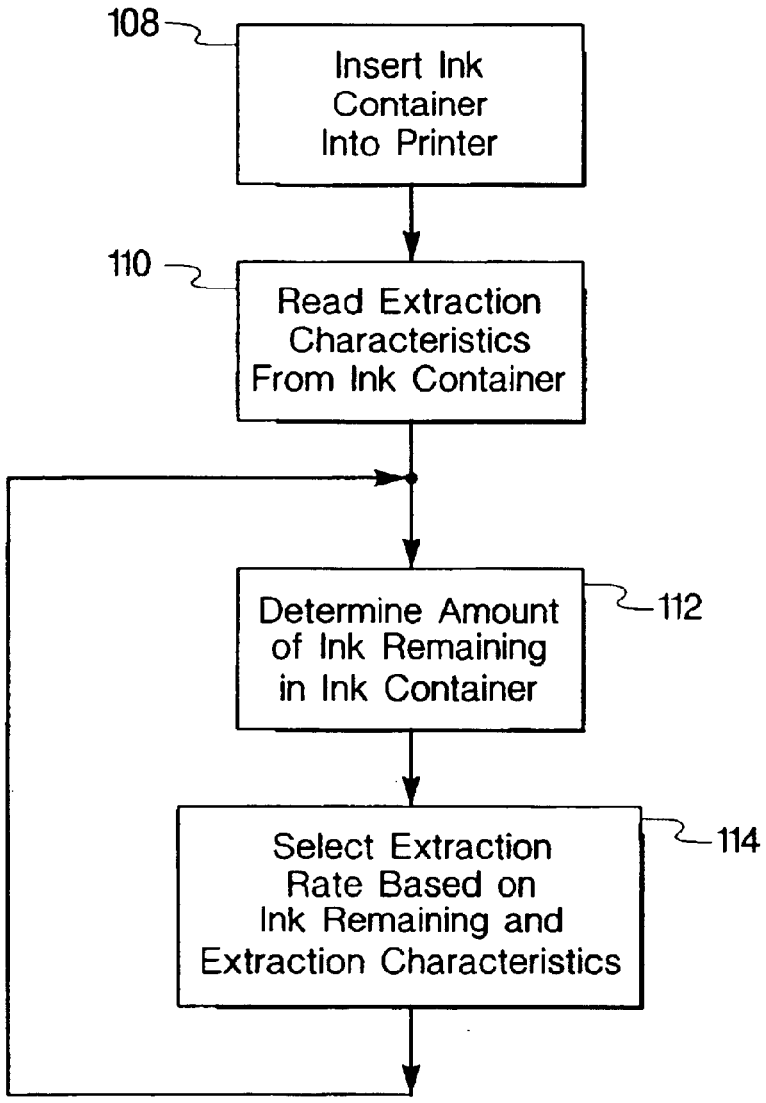
FIG. 11 is a flow diagram representing an exemplary method of the present invention for adjusting an ink extraction rate from the ink container based on the extraction characteristics and amount of ink extracted from the ink container.

FIG. 11 shows a flow diagram of one exemplary embodiment of the technique of the present invention for adjusting the extraction rate to improve ink extraction from the ink container 12. In this exemplary embodiment, a lookup table is stored within the electrical storage device 80 on the ink container 12. This lookup table contains a series of extraction rate values that correspond to varying amounts of extracted ink from the ink container 12. At specified amounts of extracted ink, an extraction rate is specified for increasing the amount of ink, which can be extracted from the ink container 12.

The ink container is first inserted into the printing system 10 as represented by step 108. Upon insertion, the controller 29 reads the extraction characteristics or lookup table that is stored in the electrical storage device 80 associated with the ink container 12 as represented by step 110. The controller 29 then determines the amount of ink remaining in the ink container 12 as represented by step 112. The amount of ink remaining in the ink container 12 is either stored on the electrical storage device 80 associated with the ink container 12 or alternatively, the controller 29 keeps track of the amount of ink printed for determining the amount of ink remaining in the ink container 12. For the case where the controller keeps track of the amount of ink printed, this information can be stored back on the electrical storage device 80 so that the electrical storage device 80 contains information for determining the amount of ink remaining in the ink container 12.

The controller 29 then selects an extraction rate based on the ink remaining in the ink container 12 using the extraction characteristics as represented by step 114. In the exemplary embodiment, the lookup table is used to determine an extraction rate based on the amount of ink extracted from the ink container 12. To achieve the desired extraction rate, the controller 29 adjusts operation of the printer mechanism 96 and printhead 16 to select the printing operations such that the desired extraction rate is achieved. During the print operation, the amount of ink extracted from the ink container 12 is monitored and the extraction rate is adjusted as necessary to improve the extraction of ink from the ink container 12.

The monochrome ink container, such as shown in FIG. 7 will in general have different ink extraction characteristics from the tri-color ink container shown in FIG. 6. The monochrome ink container has a larger portion within the reservoir 34 and therefore will have different backpressure characteristics as ink is extracted than the much smaller chambers within the reservoir 34 associated with each ink color in the tri-color ink container 12. For this reason, the lookup table associated with the monochrome ink container 12 will have different values from the lookup table associated with the tri-color ink container 12.

Figure 12:
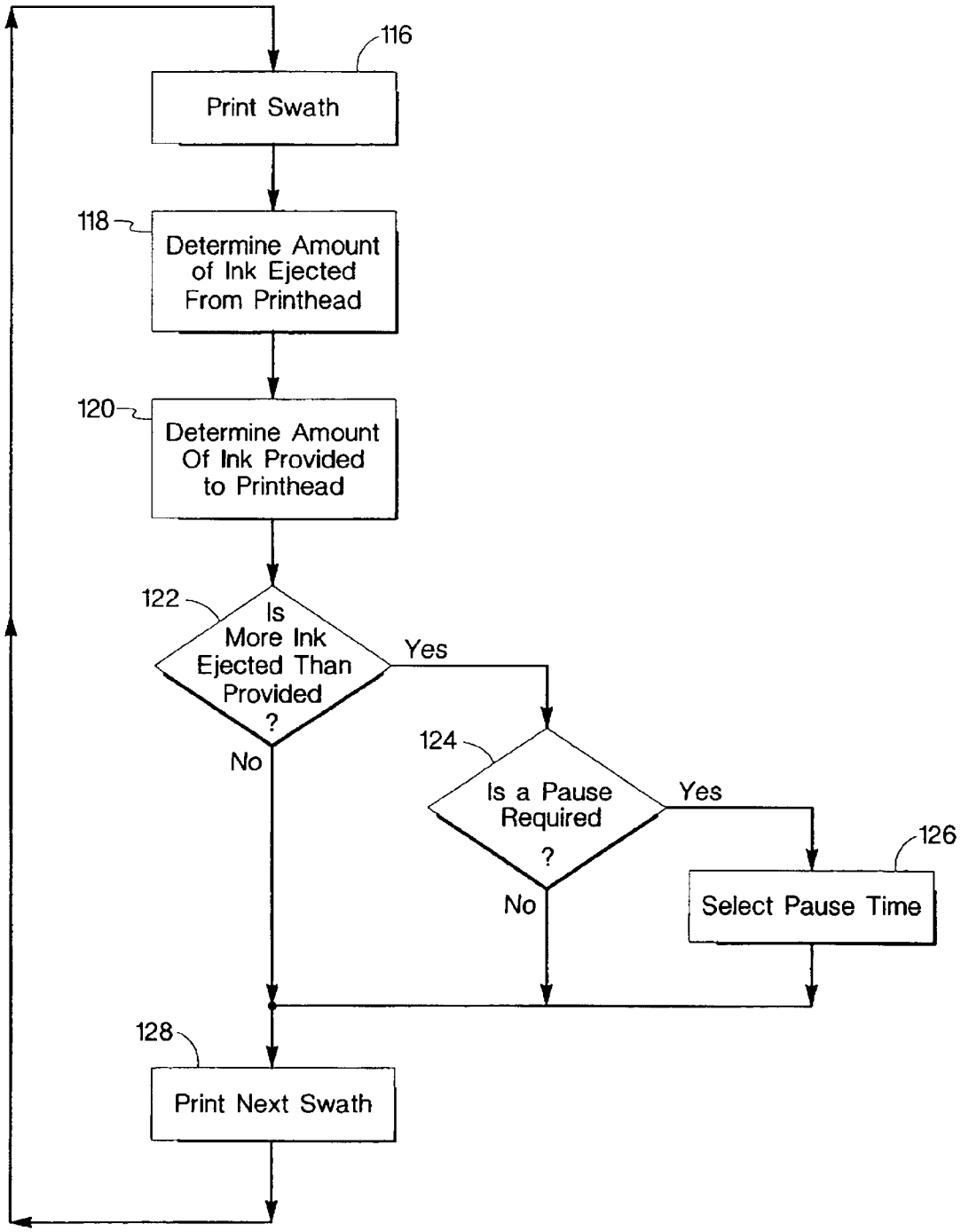
FIG. 12 is a flow diagram representing an exemplary method of the present invention for adjusting print rate for compensating for extraction characteristics.

FIG. 12 is a flow diagram of one exemplary embodiment of the technique of the present invention for adjusting the printer characteristics to compensate for extraction characteristics of the ink container 12 that vary with ink remaining within the ink container. In one embodiment, the inkjet printing system 10 makes use of the controller 29 to monitor ink delivered to the printhead 16 by the ink delivery system or ink supply 12. The controller 29 adjusts the print rate for the printhead 16 based upon the rate is being deposited on the print media. This adjustment to the print rate ensures that more ink is not flowing out of the printhead 16 than flowing into the printhead 16. If this imbalance between ink flow into and out of the printhead 16 is sufficiently large, the printhead 16 may become sufficiently low on ink such that it does not operate properly. This low ink condition within the printhead 16 is sometimes referred to as "printhead starvation" that can result in reduced print quality or a reduced printhead 16 reliability.

One exemplary technique for adjusting print rate will now be discussed with reference to FIG. 12. As discussed previously with respect to FIG. 11, an extraction rate is selected based on the amount of ink remaining in the ink container 12 and the extraction characteristics of the ink container. FIG. 12 represents a technique for adjusting the extraction rate or printing rate of the printing system 10 during a print operation. The extraction rate is adjusted during the print operation to ensure the printhead 16 does not run out of ink or does not run low on ink during a print operation. Running low of ink can result in degradation of print quality during the print operation. This reduction in print quality is particularly a problem for large format printers that require large amounts of ink to form the printed image. If one or more printheads become starved of ink, the print quality is reduced during the printing of the image. The image must be reprinted requiring additional ink and media as well as the additional time required to print the second image, increasing printing costs.

Figure 13:
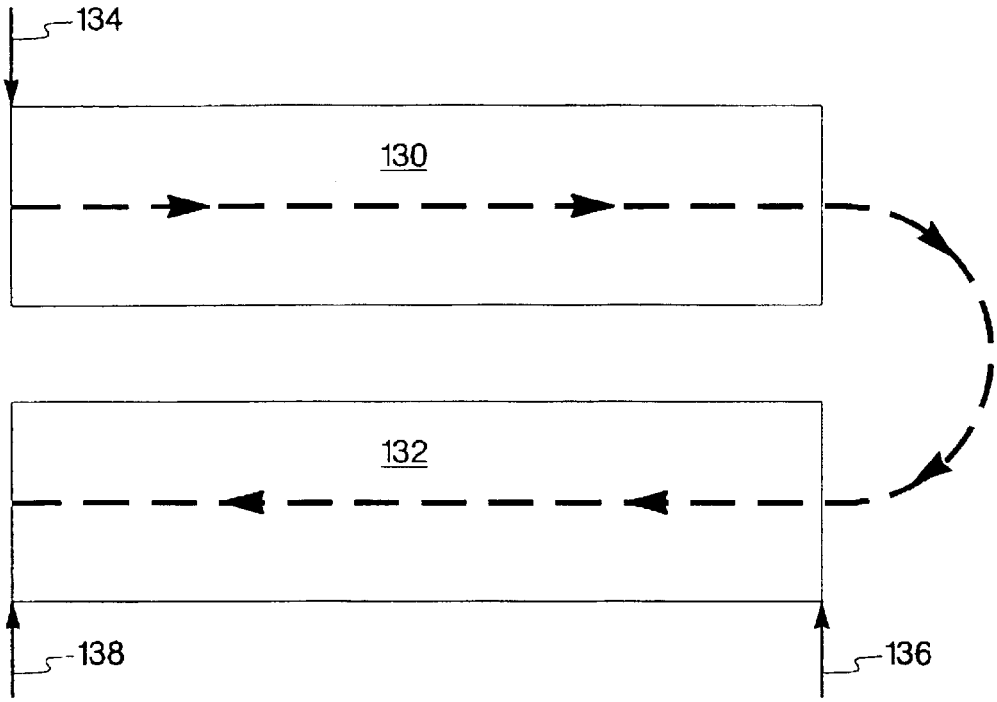
FIG. 13 is a diagram for illustrating print swaths that are defined by movement of the scanning carriage.

The method begins by printing a single print swath that forms a portion of the output image is represented by step 116 in FIG. 12. In the case of a scanning carriage printing system 10 such as shown in FIG. 1, a print swath is defined as a single pass by the printhead across the print media as represented by swath 130 in FIG. 13. The print media is typically advanced and the printheads or scanning carriage makes a swath back across the print media as represented by swath 132 in FIG. 13. Print swaths 130 and 132 are greatly simplified to show the scan direction relative to the print media.

The controller 29 determines an amount of ink ejected from the printhead 16 as represented by step 118. In an exemplary embodiment, the amount of ink ejected from the printhead is determined over an entire scan cycle, which includes printing a print swath 130 and the printing of print swath 132. The ink ejected during the printing of print swath 130 is determined to using a drop counting technique. The controller 29 keeps track of the number of drops ejected during the printing of print swath 130. Information regarding the size of each drop for the particular printhead is either stored in the controller 29 or retrieved from a memory 80 mounted to the printhead 16. An ink volume or mass of ink printed for print swath 130 is then determined by the product of the number of drops printed in that swath 130 and the drop weight or drop volume for the printhead 16.

Assuming that the output image is somewhat uniform, the amount of ink used or ejected during the printing of print swath 132 will be approximately the same as the ink usage for printing of print swath 130. The total amount of ink used in the printing of print swaths 130 and 132 represents the amount of ink flowing out or ejected from the printhead 16.

The amount of ink provided to the printhead 16 by the ink delivery system or ink supply 12 is then determined as represented by step 120. The amount of ink provided to the printhead 16 is determined based on the amount of ink in the ink container 12 and the extraction rate characteristics for the ink container 12. As discussed previously, the ink extraction characteristics change with ink level within the ink container 12. The exemplary embodiment, the extraction rate or flow rate of ink from the ink container 12 is determined from a lookup table that is stored on memory 80 on the ink container 12. This lookup table provides flow rate for a given amount of ink within the ink container 12. Once the extraction rate is established, the mass of ink that flows into the printhead 16 is the product of the extraction rate and the time required to print a complete cycle or print swaths 130 and 132.

The time required to print a complete cycle is determined by the controller 29 by setting a timer at the beginning of print swath 130 represented by referenced number 134. Once the scanning carriage is ready to begin the return print swath 132 as represented by reference numeral 136 the timer is checked by the controller 29. The time to complete the return swath 132 can then be estimated by estimating the time it will take to go from the beginning of print swath 132 represented by reference number 136 to the end of print swath 132 as represented by reference number 138. Once the time required to print a complete print cycle or print swaths 130 and 132, the amount of ink that flows into the printhead 16 during this time can then be determined by the product of the time interval and the extraction rate.

A determination is then made by controller 29 rather an imbalanced condition occurs between the ink flow in and out of the printhead 16 as represented by step 122. If more ink has been ejected from the printhead 16 then is provided to the printhead, a potential problem might occur if this imbalance is too great. If the imbalance is greater than a threshold amount as represented by step 124, an adjustment is made to compensate this imbalance as represented by step 126. The printing system 10 in this exemplary embodiment compensates for an imbalance beyond a threshold condition by pausing the scanning carriage 20 at position 136 before the return print swath 132 is printed. By pausing the scanning carriage 20, the average rate of ink usage over the entire print cycle for print swaths 130 and 132 is reduced while ink continues to flow into the printhead at the same flow rate thereby allowing ink flow in to catch up with ink flow out.

The pause time selected should be sufficient to ensure that the printhead 16 does not run out of ink while completing the print swath 132 as represented by step 128. Once the complete print cycle is completed, sequential print cycles, which include print swaths 130 and 132, are performed until the entire image is completed.

The compensation technique of the present invention in FIG. 12 has described with respect to compensating for the extraction rate characteristics of a single color provided by the ink container 12 to the printhead 16. In general, more than one ink color is used, for example, in the case of four color printing, four ink colors are used. The technique of the present invention as discussed with respect to the exemplary embodiment is performed for each ink color. The pause time that is selected will then be selected to be the largest of each of the individual paused times computed to ensure the ink usage rate is based on the printhead that has the greatest disparity between ink outflow and ink inflow.

The technique of the present invention stores extraction characteristics on a memory device associated with the ink container 12. These extraction characteristics are used by the printing system 10 to adjust operation of the printing system in order to more fully extract ink from the ink container 12 and to prevent printhead starvation during printing. By extracting more ink from the ink container 12, the ink containers do not need to be replaced as often, thereby reducing the per page printing costs of the printing system 10. In addition, by extracting more ink from the ink container 12, the amount of ink that enters the waste stream is reduced.

What is claimed is:

1. An inkjet printing system configured for receiving a replaceable ink container, the replaceable ink container having ink extraction characteristics that vary with ink extraction, the inkjet printing system comprising:

an ink extraction control device for determining ink extracted from the replaceable ink container and for selecting an ink usage rate print mode from a plurality of different ink usage rate print modes based on ink extraction characteristics of the replaceable ink containers, wherein the ink extraction control device selects the ink usage rate print mode for selectively pausing printing to reduce an average ink usage rate.

2. The inkjet printing system of claim 1 wherein the plurality of different ink usage rate print modes includes at least a first printing mode with a first ink usage rate and at least a second printing mode with a second ink usage rate different from the first ink usage rate.

3. The inkjet printing system of claim 1 wherein the replaceable ink container has ink extraction characteristics that vary with the ink level within the replaceable ink container.

4. The inkjet printing system of claim 1 wherein the replaceable ink container has a gauge pressure characteristic based on ink usage which varies with ink level within the ink container.

5. The inkjet printing system of claim 1 wherein ink extraction characteristics are stored on an electrical storage device associated with the replaceable ink container, and wherein the ink extraction characteristics are provided to the control device after installation of the replaceable ink container into the inkjet printing system.

6. The inkjet printing system of claim 5 wherein the information storage device is a semiconductor storage device.

7. An inkjet printing system configured for receiving a replaceable ink container, the replaceable ink container having ink extraction characteristics that vary with ink extraction, the inkjet printing system comprising:

an ink extraction control device for determining ink extracted from the replaceable ink container and for selecting a print mode from a plurality of different print modes based on ink extraction characteristics of the replaceable ink container, wherein each print mode of the plurality of different print modes has a different pause value associated therewith.

8. An inkjet printing system having a printhead responsive to control signals for depositing ink on media and an ink delivery system for delivering ink to the printhead, the inkjet printing system comprising:

a monitoring and control device for monitoring ink extracted from the ink delivery system and delivered to the printhead, and for adjusting rate of ink extraction from the ink delivery system during a print operation based on ink deposited on media and ink delivered to the printhead, wherein the monitoring and control device adjusts rate of ink extraction from the ink delivery system to prevent the rate of ink extraction from the ink delivery system from exceeding a rate of ink ejected from the printhead by more than a threshold value.

9. The inkjet printing system of claim 8 wherein the monitoring and control device adjusts rate of ink extraction from the ink delivery system based on a rate of ink deposited on media and a rate of ink delivered to the printhead.

10. The inkjet printing system of claim 8 wherein the monitoring and control device determines ink delivered to the printhead based on ink extraction characteristics of an ink container.

11. The inkjet printing system of claim 10 wherein the monitoring and control device determines an amount of ink delivered to the printhead over a given time interval based on an extraction rate for an ink container that is determined based on ink remaining in the ink container.

12. The inkjet printing system of claim 8 wherein the monitoring and control device adjusts rate of ink extraction from the ink delivery system by selectively pausing printing to reduce an average rate of ink extraction from the ink delivery system.

13. The inkjet printing system of claim 8 wherein the monitoring and control device adjusts rate of ink extraction from the ink delivery system by selectively controlling numbers of nozzles activated.

14. A method for operating a printing system having a printhead and a supply of ink separate from the printhead, the method comprising:

determining ink flow from the printhead;

determining ink flow into the printhead; and adjusting a rate of ink flow into the printhead during a print operation if the ink flow from the printhead exceeds ink flow into the printhead by a threshold amount.

15. The method claim 14 wherein the determining ink flow from the printhead is based on drop counting.

16. The method of claim 14 wherein the determining ink flow into the printhead is based on ink extraction characteristics of the supply of ink.

17. The method of claim 16 wherein the determining ink flow into the printhead is based on ink level within the supply of ink.

18. The method of claim 14 wherein the adjusting the rate of ink flow into the printhead is selectively inserting a pause between successive print swaths to reduce an average rate of ink flow into the printhead for successive print swaths.

19. The method of claim 14 wherein the adjusting the rate of ink flow into the printhead is selectively limiting the number of nozzles activated on the printhead.

20. An inkjet printing system comprising:

a printhead that ejects ink;

an ink delivery system that provides ink to the printhead; and a controller that determines an amount of ink from the ink delivery system that is provided to the printhead, the controller adjusting a rate that ink from the ink delivery system is provided to the printhead during a print operation based on an amount of ink to be ejected and an amount of ink provided to the printhead, wherein the controller selects an ink usage rate print mode that pauses printing to reduce an average ink usage rate during the print operation.

21. The inkjet printing system of claim 20 wherein the plurality of different ink usage rate print modes includes at least a first printing mode with a first ink usage rate and at least a second printing mode with a second ink usage rate different from the first ink usage rate.

22. The inkjet printing system of claim 20 wherein the ink delivery system comprises an ink container and wherein the controller determines the amount of ink delivered to the printhead based on ink extraction characteristics of the ink container.

23. The inkjet printing system of claim 22 wherein the controller determines the amount of ink provided to the printhead during a given time interval based on an extraction rate for an amount of ink remaining in the ink container.

24. The inkjet printing system of claim 22 wherein the controller adjusts a rate of ink extraction from the ink delivery system to prevent the rate of ink extraction from the ink delivery system from exceeding a rate of ink ejected from the printhead by more than a threshold value.

25. The inkjet printing system of claim 22 wherein the controller adjusts a rate of ink provided to the printhead by selectively controlling a number of nozzles that eject ink during portions of the print operation.

26. The inkjet printing system of claim 22 wherein the ink deliver system is coupled to an ink supply from which ink is provided to the printhead.

27. A method for operating a printing system having a printhead and an ink supply, the method comprises:

determining ink ejection by the printhead;

determining ink flow into the printhead; and adjusting a rate of ink flow into the printhead during a print operation if a rate of ink ejected by the printhead is greater than the rate of ink flow into the printhead by a threshold amount.

28. The method of claim 27 wherein determining ejection by the printhead is based on counting a number of ejections by the printhead.

29. The method of claim 28 wherein the printhead comprises a plurality of nozzles that eject ink and wherein counting a number of ejections by the printhead comprises counting a number of nozzles that eject ink.

30. The method of claim 27 wherein determining ink flow into the printhead is based on ink extraction characteristics of the supply of ink.

31. The method of claim 27 wherein determining ink flow into the printhead is based on an ink level in the supply of ink.

32. The method of claim 27 wherein adjusting the rate of ink flow into the printhead comprises selectively pausing printing between successive print swaths of a print operation to reduce an average rate of ink flow into the printhead.

33. The method of claim 27 wherein adjusting the rate of ink flow into the printhead comprises selectively limiting a number of nozzles activated on the printhead during at least a portion of the print operation.

* * * * *

UNITED STATES PATENT AND TRADEMARK OFFICE

CERTIFICATE OF CORRECTION

PATENT NO. : 6,789,883 B2
DATED : September 14, 2004
INVENTOR(S) : Heim et al.

It is certified that error appears in the above-identified patent and that said Letters Patent is hereby corrected as shown below:

Column 15,
Line 25, delete “containers,” and insert therefor -- container, --.

Signed and Sealed this

Twelfth Day of April, 2005

JON W. DUDAS
*Director of the United States Patent and Trademark Office*